United States Patent [19]

Stidworthy

[11] Patent Number: 4,838,114

[45] Date of Patent: Jun. 13, 1989

[54] ARRANGEMENTS FOR CONVERTING ROTARY MOTION TO LINEAR MOTION

[76] Inventor: Frederick M. Stidworthy, 2 Butlers Close, Long Compton, Nr. Shipston-on-Stour, Warwickshire, United Kingdom, CV36 5JY

[21] Appl. No.: 95,572

[22] PCT Filed: Nov. 29, 1985

[86] PCT No.: PCT/GB85/00547

§ 371 Date: Jul. 17, 1987

§ 102(e) Date: Jul. 17, 1987

[87] PCT Pub. No.: WO87/03333

PCT Pub. Date: Jun. 4, 1987

[51] Int. Cl.[4] ..... F16H 53/00

[52] U.S. Cl. ..... 74/568 R; 74/567; 74/569

[58] Field of Search ..... 74/567, 569

[56] References Cited

U.S. PATENT DOCUMENTS

| | | | |
|---|---|---|---|
| 1,785,736 | 12/1930 | Hess | 74/569 |
| 1,980,527 | 11/1934 | Hewton | 74/567 X |
| 2,072,990 | 3/1937 | Phillips | 74/569 X |
| 3,045,503 | 7/1962 | Kiessling | 74/569 X |
| 3,800,621 | 4/1974 | Hoglund | 74/567 |
| 3,977,263 | 8/1976 | Nara | 74/569 |
| 4,193,321 | 3/1980 | King | 74/567 |
| 4,687,425 | 8/1987 | Takano et al. | 74/567 |

*Primary Examiner*—Peter A. Aschenbrenner

*Attorney, Agent, or Firm*—Marshall, O'Toole, Gerstein, Murray & Bicknell

[57] ABSTRACT

The invention is a poppet valve arrangement with a follower member rotatable with a drive shaft about the axis of rotation of the shaft. The follower member is rotatable within a hollow cam member having an internal cam profile with which the follower member is held in contact. Either the follower member or the cam member is capable of limited linear movement in a direction transverse to the axis of rotation of the shaft, and either of the follower member or the cam member is coupled to the poppet valve so that rotation of the shaft is translated into movement of either the follower member or the cam member and thereby into linear movement of the poppet valve.

20 Claims, 6 Drawing Sheets

ARRANGEMENTS FOR CONVERTING ROTARY MOTION TO LINEAR MOTION

This invention relates to arrangements for converting rotary motion to linear motion, which arrangements find application inter alia, but not exclusively, in the instigational timing and motive forces necessary for the eventual linear operational movements of Poppet Valves. Such valves are commonly used in the intake and exhaust systems of internal combustion engines.

The invention can also be used to provide a variable instigation, from rotary to linear motion, or movement, for any type of lever or pulsed action device; for example; metering systems; pumps (particularly those of the Peristaltic type, wherein flow-rate, as against pressure, can be varied); hammer-action drills and devices etc.; pressure loading devices are used to fill, or form, containers (e.g.; the material content of say, a Tooth-paste tube, or the plastic injection device as used in the manufacturing process of the tube itself, etc;); reciprocation couplings of all kinds, especially internal combustion engines; timing devices etc.

The description, herein contained, is concerned with the uses involved with the gas flow to, and form, an internal combustion engine cylinder, however, the basic principles hold good for any other application, and the simplicity of the device can be well illustrated within this context.

Internal Combustion Engines, used as they are, in a variety of ways; e.g. Cars; Lorries; Trains; Aeroplanes; Boats; Motor Cycles; Generators; Pumping Units; etc. etc., are all able to benefit from an ability to vary the valve timing, especially if this can be accomplished while the engine is running and at any engine revolutionary speed.

The control system for this invention, can be of any suitable type, however, it would seem logical to include a micro-processor in order that maximum effect, at all times, can be realised.

In order that the invention may be readily understood, embodiments thereof will now be described, by way of example, with reference to the accompanying drawings, in which.

It will be seen that th Roller (3) is a free-running component, and is situated at the radial tip of the Follower (4) and is in contact with the Internal, Concentric Annular Surface (2). This Roller (3) may be of any suitable type, and in some embodiments, may be dispensed with altogether with the tip of the Follower (4), being in direct, or indirect (i.e., via some other suitable bearing device or item) with the Internal, Concentric Annular Surface (2).

It is assumed, in this particular embodiment, that Main-Shaft (1) is able to rotate in either direction and that it's centre datum remains constant.

The concentric centre of the Internal Concentric Surface (4) being the same as the Main-Shaft Centre Datum.

Throughout this description, all 'solid' black areas are representative of bearing surfaces and/or devices etc.

Therefore, it will be seen, that the internal Guide-Walls (4*a* and 4*b*) of the free moving Follower (4) are in bearing contact with the parallel side surfaces of the Main-Shaft (1).

The cross-section of the Main-Shaft is indicated as being basically square in profile, however, this section can be of any suitable cross-section capable of providing a rotary drive bond between the Shaft (1) and the Follower (4) i.e.; this can, if required, be a multi-shaft component etc.

Figure 1:
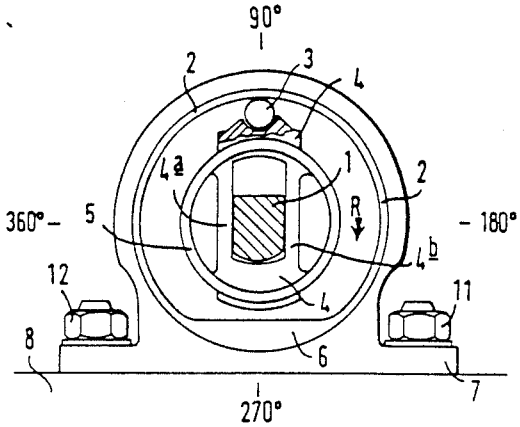
FIGS. 1 to 3 illustrate a first arrangement embodying the present invention.
Figure 2:
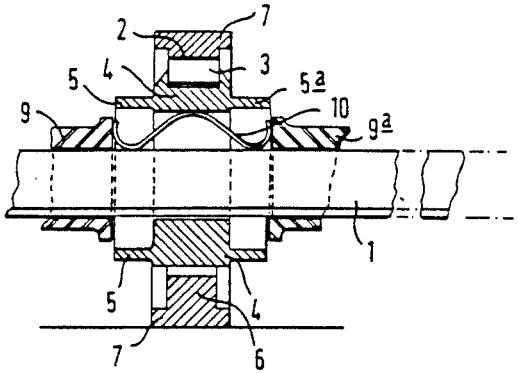
Figure 3:
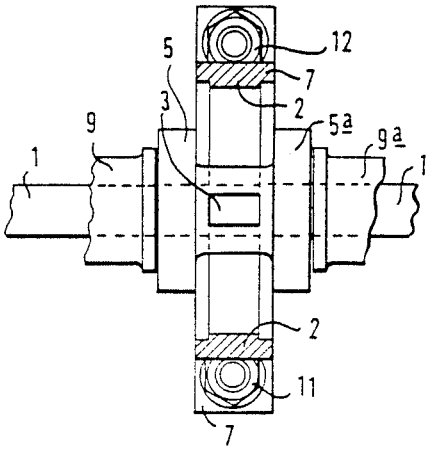

FIG. 2 indicates that Follower (4) is restricted in any lateral movement along the Main-Shaft (1) by the Spacers (9 and 9*a*). FIG. 2 is a cutaway side elevation of the device depicted in both FIGS. 1 and 3. FIG. 3 being a 'top' or plan view of said device.

Follower (4) is, therefore, able to reciprocate across the axis of Shaft (1) but must be rotated by Shaft (1), with its contact Roller (3) remaining in touch with the internal Annular Concentric surface (2).

If the Main Shaft (1) and Follower (4) is rotated, as suggested by the 'R' Directional Arrow, it will be seen that at instigation; i.e.; 90 degrees, the Roller (3) is simply in contact with the internal Annular Surface (2) and as the Main-Shaft is rotated through 90 degrees, the Roller (4) will remain in concentric contact with the internal Annular Surface (2), and it is not until the Roller (3) reaches the 225 degree mark, that its concentric path is interrupted, however, this eccentricity can be situated anywhere around the internal periphery, but in the example shown, the change in internal diameter occurs at 225 degrees and also at 35 degrees, this representing a single intake or outlet stroke of an internal combustion engine. The area between 225 degrees and 315 degrees coinciding with a single linear excursion of a (or the) piston.

Therefore, it will be appreciated that the internal eccentricity is capable of providing a measurable amount of movement in the Follower (4); i.e.; as the Roller (3) moves around the internal Concentric Surface (2) it remains at a constant D.P. or Diametric Pitch; ie; a constant Pitch-Circle is maintained, however, as the Roller (3) encounters the change in the internal diameter (in this case a restrictive one) it will necessarily require to move away from the obstructive surface and, in this case, cause the follower to move across the Main-Shaft Datum.

In FIG. 2, it will be seen, that there is placed between the Main-Shaft (1) and the internal surface of the Follower (4); i.e.; directly beneath the Roller cavity; a Spring (10). This item can be of varying abilities; i.e.; it can be of sufficient strength to replace entirely the normal Poppet Valve return spring, or it can be of a very mild type, in that its sole function is to ensure contact between the Roller (3) and the internal surfaces of the Annular-Cam (2 and 6). This "spring" can also be of a fluid type, rather than a simple mechanical one as illustrated; i.e.; oil pressure may be introduced or any other type of "sprung" action/reaction capability included.

In FIG. 1, it will be seen, that the 270 degree point represents the 'peak' or maximum cam effect, with the area between 225 degrees and 270 degrees being the opening ramp and the area between 270 degrees and 315 degrees being the closing ramp. The maximum 'lift' being the distance between the minimum internal diameter at 270 degrees and the maximum internal diameter between 315 degrees and 225 degrees. It will be clear that a single internal, or Annular Cam (2/6) could contain more than one eccentricity of either (and/or) an internal or external nature; furthermore; if the Follower (4) were fixed to the main shaft (1), then the Annular Cam (2/6) could be made to reciprocate to exactly the same way. This variation is hereby anticipated, and can be understood, in that, if the Spring (10) were of sufficient ability to 'seal' a Poppet Valve against the Valve Seat, and the Annular Cam (2/6) were attached directly to the Valve itself, then a spring assisted Desmodromic system could be realised. (Not Drawn).

The basic intentions, therefore, of device (FIG. 1-3) is to provide a cam activated follower which is capable of transmitting its defined movements to a lever or other such device. As it stands, it is able to provide a Roller contact Cam and thereby reduces the frictional loadings of the cam-shaft assembly; furthermore; the fabricated nature of the cam-shaft; i.e; the Followers and spacers etc., would allow a set of similar components to be assembled by sliding the items on to the basic Main-Shaft, in any order and set at any radial degree; i.e; the followers surfaces between themselves and the follower in question being provided with a guide, angled at the required angle etc.

The means of advancing, or retarding the opening (and/or closing) threshold of the Annular Cam, can be accomplished by providing the Main-Shaft with a 'helix' or twist; i.e; if the side bearing surfaces were twisted along the shaft axis, either locally to a particular follower (4) or as a general feature along the entire length of said shaft (1), then, by moving the shaft laterally through the follower, or followers, the radial engagement between the shaft (1) and one, or several Followers could be alterated; i.e; if the Main-Shaft (1) is rotating at some speed relative to the main crankshaft of the engine in question, then by sliding the Main-Shaft (1) backwards and/or Forwards through a Follower (4) combination of similar Followers, the Helical, or twisted parallel side faces of said shaft will cause the radial angle of said follower, or followers, to change while the Main-Shaft and Crankshaft relationship remains constant.

It will be realised, that unlike any other system (Example British Patent Applications 8225238 and 8401405) wherein the Camshaft (with sited, or fixed Cams is simply slid backwards and forwards across a follower, there is no 'point' contact problems to overcome; i.e; the roller (3) remains in constant full surface contact regardless of the change of timing etc.

Item F-4. introduces a further variation to the system, in that, the previously fixed Cam-Holder and Annular Cam unit (7/2/6) is replaced with a rotatable Annular-Cam component (2/6), held in bearing location, within a fixed Cam-Holder (18). The Annular-Cam (2/6) is shown as being part of an annular component (19) which itself is part of an external Worm-Wheel (15); i.e; the Annular component (19) is simply cut on the external periphery with a Worm-Wheel tooth arrangement. This can be a separate item if necessary. The same component (19) is provided with an internal, or Annular-Cam (2/6) and again, thi may be separate or machined from the same item of material, depending upon requirements. The whole item, or assembly (2/6/19/15) is provided with retaining faces (16 and 17) to allow it to locate within the bearing surfaces of the Cam-Holder (18). The entire unit (2/6/19/15/16/17) is able to rotate through 360 degrees.

The Worm-Wheel (15) is shown to be engaged with a Worm (13) mounted on a drive shaft (14). This is itself driven by any suitable means; e.g; an electric motor etc.

It will, therefore, be appreciated, that if the Worm (13) is rotated, the assembly (2/6/19/15/16/17) will be caused to rotate, and providing sufficient ratio reduction between the Worm (13) and the Worm Wheel (15) is provided; e.g; 200: 1; then a very small motive power source can be used; furthermore, if a 'locking' angle of say 10 degrees is used between the engaged faces of the Worm and Worm-Wheel, then the Rotatable Cam Assembly (2/6/19/15/16/17) can be positioned, and locked, in any suitable attitude. Furthermore, the frictional emphasis applied to the Annular-Cam (2/6) by the Roller (3) will not be able to inadvertently cause the assembly (2/6/19/15/16/17) to rotate. This large reduction factor also allows for very small amounts (increments) of rotation to be applied to assembly (2/6/19/15/16/17).

If, therefore, a similar Follower (4)/Shaft (1) assembly is included along datum 'x'—'x' and the Worm (13) is used to rotate the Annular-Cam (2/6), it will be realised that the whole of the 'opening/closing' envelope as situated between 225 degrees and 315 degrees can be adjusted, and/or repositioned at will. Advanced or retarded according to requirements.

This feature allows individual, or 'ganged' (grouped) valves to be adjusted without the use of cam-shaft helix, although this could also be included as a further means of timing modification.

The use of a Worm/Worm-Wheel device is a simple means of effecting rotation, however, any suitable means can be employed; e.g; spur-gearing or simple lever trains etc; and/or hydraulic or any pressure fed or chain (or belt) coupled system etc.

In item F-2; the Followers (9 and 9*a*) can be fixed (no lateral movement) or sliding (lateral movement included).

The Output-Rings (5 and 5*a*) as shown in FIGS. 1; 2; and 3.; are provided in order to allow the output being split between two valves of similar active sequence or will as a double output to a single valve, via a 'forked' rocker arm or lever device. In FIGS. 1, 2, 3 and 4 the contact between the Output-Rings (5 and 5*a*) and the Rocket am would, it is assumed, be across the top of said Output-Rings, however, internal Output Rings can be substituted, and rocker contact can be made at any tangential angle.

Drawing Sheet AC-2; contains a simple diagrammatic layout (F-10) of a basic embodiment of the type described in FIGS. 1, 2, 3 and the rest of the valve train is included.

Basic Components: —Rocker-Arm (20); Contact-Shoe (21); Rocker Pivot Axle (22); Rocker Collar (23); Rocker Pivot Holder (24); Base-Plate (25); Rocker Output Head (26); Valve-Spring Cap (27); Valve-Spring (28); Poppet Valve (29); Valve-Guide (30); Cylinder-Head (or Base) (31); Outlet (or Intake) Port, or Duct (32); Valve-Seat (33).

Figure 4:
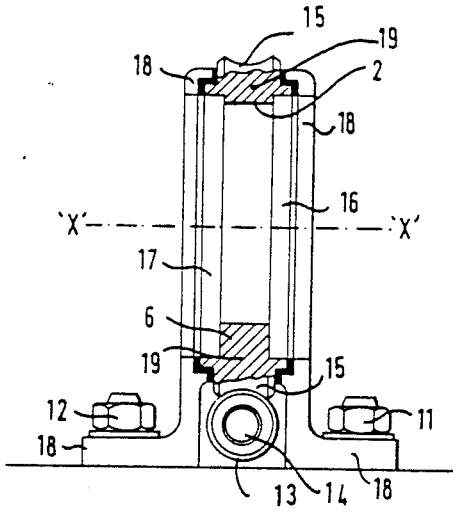
FIG. 4 illustrates a modification of the arrangement of FIGS. 1 to 3.
Figure 10:
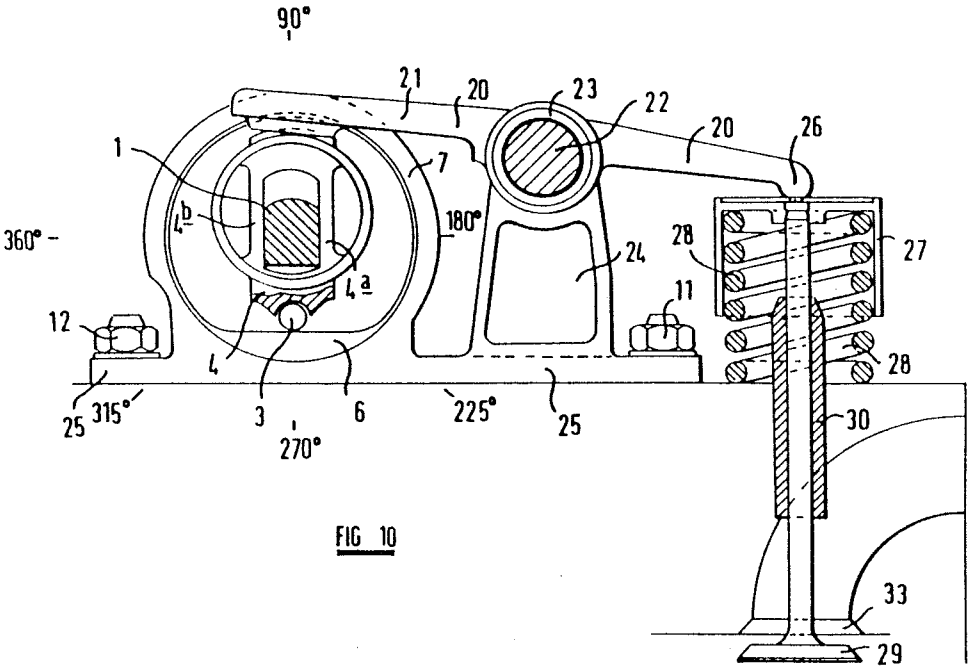
FIGS. 10 to 15 illustrate the application of arrangements embodying the invention to poppet valves.

The layout as depicted in FIG. 10, would use a helical shaft approach in order to effect timing variation, however, if the fixed Cam-Holder (7) were replaced with a unit as drawn in FIG. 4 then the variation could be effected as described by this embodiment. Here again, however, both the FIG. 4 and Helical shaft approached can be used at the same time if required.

The basic "mounting device" (11 and 12) are of the nut and bolt type, however, any suitable means of attachment can be used and in many cases, the various Holders etc.

FIG. 10 shows a Poppet Valve (29) in the open position with the Roller (3) in the 270 degree "peak" location. It will, however, be appreciated that the lever length of the two Rocker (20) arms can be varied to provide variations of leverage and distance travelled etc. (either side of Pivot 22).

Figure 5:
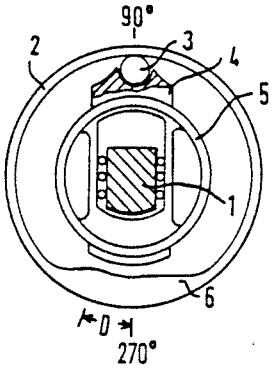
FIG. 5 illustrates another modification of the arrangement of FIGS. 1 to 3.

FIG. 5 is similar in most respects to FIG. 1 however, the bearing surfaces between the Main-Shaft (1) and the Follower Side-Walls (4 and 4a) have been provided with Roller devices. These may be caged or attached, in free running location to either, or both, the Main-Shaft (1) and/or the Follower (4). This inclusion can reduce friction forces between the Main-Shaft (1) and the Follower (4).

FIG. 5, also includes a cam profile variation, in that, the 'opening' ramp between 225 degrees and 270 degrees (peak) remains as in previous devices, the closing ramp between 270 degrees and 315 degrees is modified to include a longer dwell at peak 'D'. This is included to illustrate that the cam profile can be of any desirable and suitable nature and can extend beyond the 45 degree confines as already described. (e.g; between, in these cases, 225 and 315 degrees).

Figure 6:
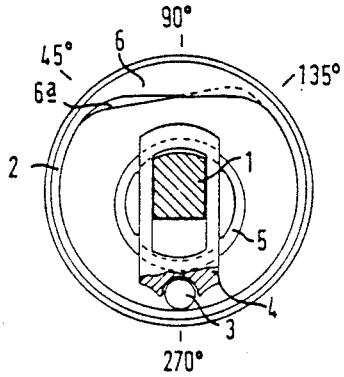
FIGS. 6 and 7 illustrate a further modification of the arrangement of FIGS. 1 to 3.
Figure 7:
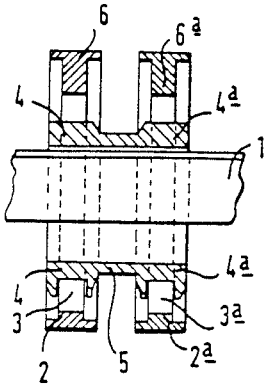

Drawing Sheet AC-1; contains two drawings FIGS. 6, 7 these representing a further variation.

This embodment contains two Annular-Cams (2/6) and (2*a*/6*a*), either of which can be fixed, as in F-1; and either of which can be rotatable as in FIG. 4.

The Follower (4) is a 'double' follower with two Rollers (3 and 3*a*); Roller (3) tracing the Annular-Cam (2/6) and Roller (3*a*) tracing Annular-Cam (2*a*/6*a*).

As both Rollers are directly contact located within the single follower (4), it is clear that if both Annula Cams are perfectly aligned, with their internal periphery profiles of similar design, then the follower (4) will react in ony one way; i.e; as programmed by the parallel profiles, however, if we assume that Cam (2/6) is static, ie; fixed; and Cam (2*a*/6*a*) is rotatable, as in F-4; then an overlapping of the two similar profiles can produce an advanced or retarded opening and closing timing sequence. This can be achieved without advancing or retarding the whole envelope.

It will be clear that dissimilar profiles can be overlapped in this way to produce many variations, accelerations, dwells, peaks etc.

Figure 11:
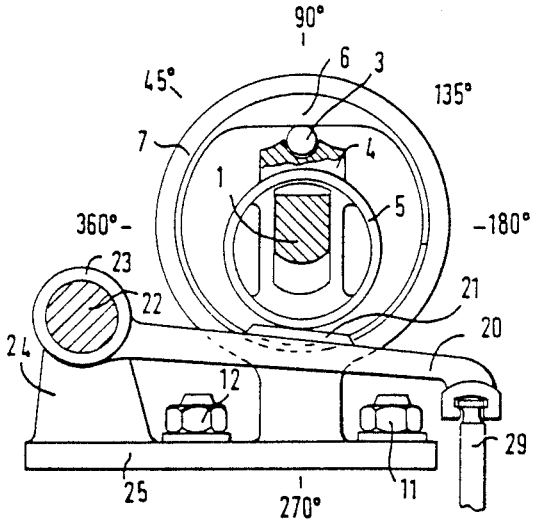

In FIG. 6/7 it will be seen that the 'active' eccentricity (cam) has been moved from a 270 degree peak to a 90 degree peak location, this would provide for a direct lever type rocker', of the kind illustrated in FIG. 11 Drawing Sheet AC-2.

Furthermore, the Output-Ring (5) is now a single item situated between the two Follower segments (4 and 4*a*).

In all previous embodiments, the Output-Rings were of concentric construction, with a diametric centre based upon the Main-Shaft datum centre, with the Roller in contact through 315–225 degrees, this created on Output-Ring which was only eccentric between 225–315 degrees, however, the smaller diameter of the output-ring of FIG. 6/7 would produce further eccentricity, therefore, this compound eccentricity can be included, or, if required, Output-Ring types as already defined can be included.

Drawing Sheet AC-2; FIG. 11 depicts a simple lever-rocker (tappet) assembly, with the Annular-Cam (2/6) peaking at 90 degrees. The basic components are as follows:- Main-Shaft (1); Concentric Annular Surfaces (2); Roller (3); Follower (4); Output-Ring (5); Cam (6); Cam-Holder (7); Mounting Devices (11 and 12); Lever-Rocker Arm (20); Contact-Shoe (21); Lever-Pivot (22); Lever Pivot Collar (23); Pivot-Holder (24); Base-Plate (25); Poppet-Valve (29); NOTE: Valve Return-Spring not included.

The Follower/Annular-Cam assembly can be of any type herein described and the basic timing adjustment can be of the helical shaft type.

If, however, a rotatable Annular-Cam assembly is included, then this embodiment lends itself ideally to compound cam variation.

If the Contact-Shoe (21) was to be inclined, rather than flat, this could be moved along the Lever-Rocker Arm (20), thereby increasing, or decreasing the eccentric effect created by the follower.

Furthermore, if the Helical Shaft arrangement is included, then this effect, can be further varied; furthermore, if the Contact Shoe (21) is of the ramp type, but fixed in location, this could be used in conjunction with a fixed type follower with an eccentric Output Ring. The Contact-Shoe could be convex, and the whole cam action based upon the eccentricity created by the off-set circular Output-Ring. This, together with Helical-Shaft adjustment can create a further set of embodiments of the Annular Cam type, of a type (not drawn) in which the eccentricity is created by a fixed (non-reciprocation type follower) Output Ring.

Figure 14:
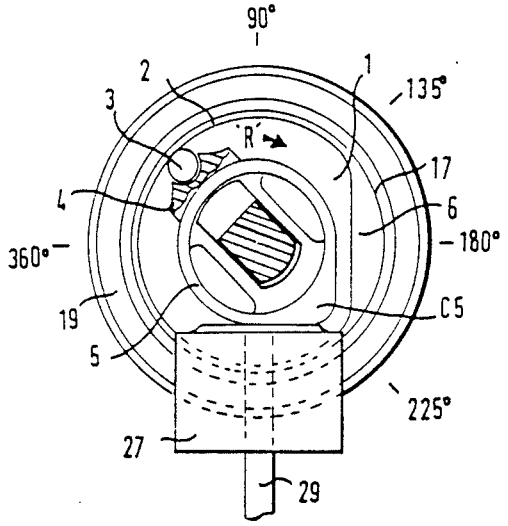
Figure 15:
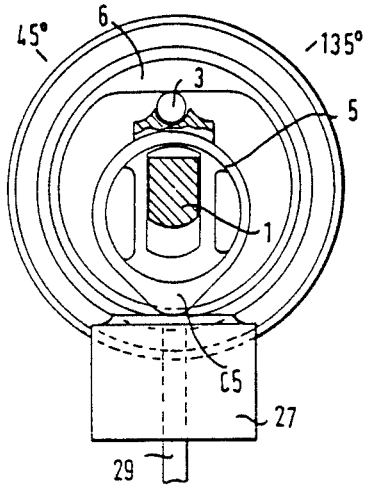

FIGS. 14 and 15 depict a further variation of the basic theme, and one which includes Compound Cam operation.

The Layout is of the Overhead Valve/Camshaft type, in that, the Camshaft is situated directly above the valve, and operated directly against the Valve-Cap, etc.

It will be seen in F-14; that the Annular-Cam (6) is situated to peak at 180 degrees, and that the Output-Ring (5) is provided with a normal Cam-lobe (C5).

This means that if the Main-Shaft (1) is rotated, with Annular-Cam (6) in its present position, then only (C5) will be effective, as the eccentricity of (6) will only be effective in moving the circular surface of (5) across the Contact-Shoe (21). This is virtually a standard cam action unit, however, if the Annular Cam (6) is rotated in order that it assumes the 90 degree Peak position as shown in FIG. 15 as it can be seen, the peak of C5) coincides with the Peak of (6) making a compound cam effect possible. The ability to modify the amount of effect and/or the timing of the compounding, allows throttling by valve to be made possible, and if the various other innovative possibilities are included; e.g.; helical shafting, and Ovelapping effects of two parallel Annular-Cams etc. then the variations are almost endless, and full internal combustion flexibility can be realised.

Throttling by Valve can be achieved, for example, by making (C5) a very shallow acting cam, with sufficient lift to allow engine running at idle, the compound effect then allowed by the Annular Cam coming into effect as (6) is moved (rotated) to an effective position, increasing the effective lift and, as a result, the valve (intake) could throttle the engine.

Figure 8:
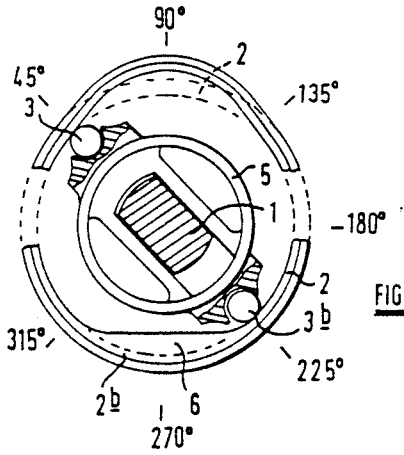
FIGS. 8 and 9 show a second arrangement embodying the present invention.
Figure 9:
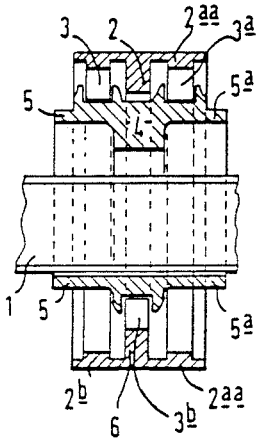

FIGS. 8 and 9 are concerned with a Desmodromic Cam, in that F-9 shows a Follower (4) provided with three Rollers (3/3*a*/3*b*), these in contact with three annular cam units (6/2); (2*b*) and (2*aa*); items (2*b* and 2*aa*) having no effective eccentricity, but containing 'negative' cam profiles.

In order that all three Rollers (3/3*a* and 3*b*) remain in contact with their respective Annular surfaces, the fact that Roller (3*b*) meets with Annular-Cam (6), means that a 'negative' or take-up area must be provided between 45 degrees and 135 degrees in the two Annular surfaces of items (2*b*) and (2*aa*), these allowing the follower (4) to move away from (6) which peaks (as shown) at 270 degrees. This Desmodromic assembly has two Output-Rings (5 and 5*a*) and can be mounted in a Cam-Holder assembly of the type drawn in F-4, furthermore, Helical Shafting can be included.

Figure 13:
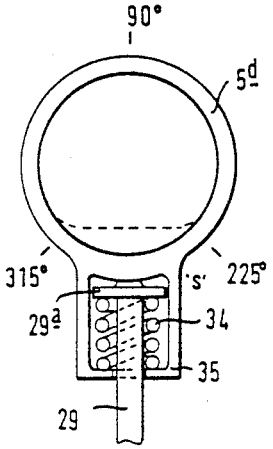

If however, Assembly (2*b*/2/6/2*aa*) were directly connected to a Valve (29), and Follower/roller assembly (4/3/3*a*/3*b*) were prevented from reciprocating across Main-Shaft (1), then a desmodromic Valve would be achieved, furthermore, the Helical Shafting arrangement could still offer timing variation, and contact between the Annular assembly (2*b*"2/6/2*aa* could be double-sprung, (See: FIG. 13). This preventing noisy operation.

Figure 12:
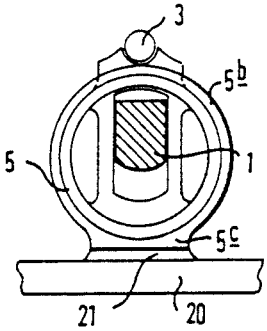

FIG. 12, is a slight variation on the theme depicted in FIG. 11 in that, the Contact Shoe (21) is provided with a 'flat' contact area added to the Output-Ring (5) by way of a free-running annular outer ring (5*b*). The 'flat' (5*c*) cam be bearing located as indicated, and the inclination of the mated surfaces can be to any suitable ramp angle.

FIG. 13, is a Desmodromic connection suitable for use with a Cam device as described by FIGS. 8, 9 in that, the annular-ring (5*d*) and its bearing surface, could be placed, in free-running contact, around the outer periphery of the Output-Ring (s) of Follower (4). The spring (34) Diagram F-13; is intended to provide adequate seat sealing for valve (29), the stem of which, passes through an opening in the Spring-Cage (35) which is attached to Desmodromic-Ring (5*d*).

A further cushion spring, or damper, can be insinuated a point 'S' if required.

This assembly as shown by FIG. 13 can be used with almost any of the arrangements shown throughout this Specification.

If the dotted 'cam' were included within ring (5*d*) and the bearing surface modified accordingly, and the Roller (not shown) were mounted on an eccentric of a shaft centred at circle centre as shown (+), and the eccentric roller was in contact through the entire 315–225 degree arc, without any undue movement of ring (5*d*), when 225 degrees was reached, the cam action would be instigated, and maintained through 225–315 degrees. The sealing spring (34) could be directly reacted against the cylinder head, in the usual way, and timing variation could be realised via helical shafting techniques. This is yet another possible variation hereby anticipated, and like all the versions included in the specification, is not dependent upon 'point' contact. Any of the various embodiments herein included can be used in conjunction with any other to create the desired effects, and it will be appreciated that in all cases the simplicity of the devices will enable easy production techniques to be utilised, in that, most components are common to each other as their effective positions can be 'adjusted' in.

In order to emphasise some of the benefits of being able to vary the valve timing, it is interesting to note actual test results achieved by Fiat of Italy, on a 2 Liter Engine, the figures related to Torque increases at various speeds of engine operation and were achieved by the sliding Camshaft device as described by (British Patent Application Nos. 8225238 and 8401405).

EXPERIMENTAL 2 LITER ENGINE

1000 RPM, +40%
1500 RPM, +29%
2000 RPM, +15%
2500 RPM, +5%
3000 RPM, +2%
3500 RPM, +2.4%
4000 RPM, +3.6%
4500 RPM, +5%
5000 RPM, +6.2%
5500 RPM, +8

These figures, though impressive, indicated only part of the capability of the abilities of the invention herein included, for while this invention is much more simple than that used by Fiat of Italy, it also offers far wider timing and cycle variation, furthermore, it completely removes the 'point' contact problems as tackled by the Fiat designers and allows variations impossible by the Fiat experiments.

All of the embodiments; FIGS. 1/5 can be used in conjunction with Delayed Tension Springing, as described in British Patent Application Nos. 8213983 and 8401404.

Furthermore, the basic Annular Cam principles can be used in the main reciprocating elements of the piston to output shaft couplings of internal combustion engines of any type.

In all embodiments herein described, the Follower (4) is depicted as being external of the Main-Shaft (1), however, the follower can be made to pass through the shaft, with the necessary bearings included (a peg arrangement). Furthermore, the coupling of Output-Ring to Roller Follower can be made hydraulically if required.

It should be pointed out that in the case of the Fiat Experimental Engine, only Torque increases are noted, however, these directly relate to possible fuel, and subsequently, pollution savings and, furthermore, the savings in basic engine sizes without output power loss; i.e; engine size can go down and as the low R.P.M. torque has increased by 50%, it is clear that 2 speed gearboxes would be more than adequate.

In FIG. 14 and FIG. 15, it can be demonstrated that an annular Cam can be positioned, in such a way, as to make it ineffective, this ability can be realised by any of the devices herein included, as the Cam action, created by the internal eccentricity, can be moved to a position which, while still causing the Follower to reciprocate, does so at a time when the effect is not transmitted to the Valve, or Lever etc. The ability to negate the Cam action could be particularly useful in Engine Management, in that, it would allow the shutting down of selected cylinders; i.e; the Valves to a particular cylinder, or group of cylinders, could be closed and the engine in question 'altered in size'; i.e; the effective cylinders being reduced according to requirements.

If the cylinders are closed down with the valves closed in this way, the piston would still retain its compressive capabilities, and this would cause a loading on the engine (i.e; the still operating cylinders etc), however, the gas under compression would have nowhere to go and, therefore, compressive 'springing' would aid the piston in question on each return stroke, cutting the 'losses' considerably.

If it is considered desirable to close down a cylinder with the valves, or a valve, open, then a simple lug can be added to the rotatable assembly; e.g; as in FIG. 4, 19/2/6/17/16/15, in order that it locates upon the rocker, or lever, in such a way as to by-pass the cam action and depress the valve spring. Once depressed fully (or partially) the valve/valve-spring assembly, would be allowed to remain stationary; i.e; open.

A further ability offered by this invention, is that the compression ratio of the engine can be altered, in that, the ability to overlap the various cyclic operations; i.e; the 'intake' stroke can now be caused to be moved; e.g; advanced and/or retarded etc., offers the change to alter the length of said sequences, in that, the time allowed for the 'intake' to remain 'open' will, as suggested by the concept of Valve Throttling etc., allow considerable performance advantages, however, by allowing the intake valve to 'overlap' into the compression stroke, thereby pumping out a portion of that previously ingested, the effective volume can be reduced. This will, it will be appreciated, allow for variable compression.

It is considered, by the inventor, that this innovative set of Cam principles, herein described, offer, for the first time, all the flexibility required in order to take the internal combustion engine to limits of its full potential; the idea is simple, easy to produced in quantity and very easy to control. There are no obvious speed restrictions and wera is to be less than in conventional valve/cam systems.

I claim:

1. A poppet valve arrangement comprising:

a follower member rotatable with a drive shaft about the axis of rotation of the shaft;

the follower member being rotatable within a hollow cam member having an internal cam profile with which the follower member is held in contact;

one of the follower member and cam member being capable of limited linear movement in a direction transverse to the axis of rotation of the shaft; and the said one of the follower member and cam member being coupled to the poppet valve so that rotation of the shaft is translated into movement of the said one of the follower member and cam member and thereby into linear movement of the poppet valve.

2. An arrangement according to claim 1 in which the drive shaft extends through an aperture in the follower member which is elongated in the direction transverse to the axis of rotation and the shaft and the aperture in the follower member have cross sectional shapes such as to cause the follower member to rotate with the shaft whilst permitting displacement of the follower member transversely of the axis of rotation.

3. An arrangement according to claim 1 in which the follower member is slidably received in an aperture extending transversely through the shaft and the follower member and the aperture in the shaft have cross sectional shapes such as to cause the follower member to rotate with the shaft whilst permitting displacement of the follower member transversely of the axis of rotation.

4. An arrangement according to claim 2 in which the shaft has at least one flat surface extending parallel to the axis of rotation.

5. An arrangement according to claim 3 in which the shaft has at least one flat surface extending parallel to the axis of rotation.

6. An arrangement according to claim 5 in which the shaft has a pair of flat surfaces extending parallel to the axis of rotation and to one another.

7. An arrangement according to claim 2 in which the follower member carries a roller which contacts the internal cam profile of the cam member.

8. An arrangement according to claim 3 in which the follower member carries a roller which contacts the internal cam profile of the cam member.

9. An arrangement according to claim 2 in which the follower member is biased into contact with the internal cam profile of the cam member by a spring acting between the shaft and the follower member.

10. An arrangement according to claim 3 in which the follower member is biased into contact with the internal cam profile of the cam member by a spring acting between the shaft and the follower member.

11. An arrangement according to claim 2 in which the follower member is provided with a circular output surface via which movement of the follower member is transmitted to the poppet valve.

12. An arrangement according to claim 3 in which the follower member is provided with a circular output surface via which movement of the follower member is transmitted to the poppet valve.

13. An arrangement according to claim 11 in which the output surface has an eccentric region.

14. An arrangement according to claim 12 in which the output surface has an eccentric region.

15. An arrangement according to claim 1 in which the said one of the follower member and cam member is coupled to the poppet valve by a rocker lever pivoted between its ends, with one of the follower member and cam member acting on the lever on one side of the pivot.

16. An arrangement according to claim 1 in which the said one of the follower member and cam member acts on the poppet valve via a pivoted rocker lever on which one of the follower member and cam member acts at a point between the pivot and the poppet valve.

17. An arrangement according to claim 1 in which the said one of the follower member and cam member acts directly on the poppet valve.

18. An arrangement according to claim 1 in which the cam member is capable of controlled angular movement about the axis of rotation of the drive shaft.

19. An arrangement according to claim 18 in which the cam member is capable of angular repositioning and locking in a selected angular position.

20. An arrangement according to claim 19 in which the cam member is angularly repositioned by way of a worm and worm-wheel combination capable of performing both the necessary rotational movement and the locking action.

* * * * *